US006029576A

United States Patent [19]

Fischer et al.

[11] Patent Number: 6,029,576

[45] **Date of Patent: *Feb. 29, 2000**

[54] METHOD FOR CONTROLLING IMAGE FORMATION ON A PRINTING FORM CARRIER FOR A PRINTING PRESS

[75] Inventors: Gerhard Fischer, Sinsheim; Roland Pudimat, Eberbach, both of Germany

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,103

[22] Filed: Sep. 13, 1996

[30] Foreign Application Priority Data

Sep. 13, 1995 [DE] Germany ..... 195 33 810

[51] Int. Cl.[7] ..... B41F 31/00

[52] U.S. Cl. ..... 101/485; 101/248

[58] Field of Search ..... 101/151, 248, 101/171, 181, 211, 483, 484, 485; 345/118

[56] References Cited

U.S. PATENT DOCUMENTS

| | | | |
|---|---|---|---|
| 4,495,582 | 1/1985 | Dessert et al. | 101/248 |
| 5,323,706 | 6/1994 | Sugawara | 101/114 |
| 5,375,516 | 12/1994 | Hasegawa | 101/115 |

FOREIGN PATENT DOCUMENTS

| | | | |
|---|---|---|---|
| 0 518 559 A1 | 12/1992 | European Pat. Off. | 101/181 |
| 0 668 164 A1 | 8/1995 | European Pat. Off. | 101/181 |
| 42 32 434 A1 | 4/1994 | Germany | 101/181 |

OTHER PUBLICATIONS

"Theory and application of hydrometers in offset printing machines", Paper and Press 23, 1974, (Helbig et al.), pp. 157–160.

"Measure and control strip for controlling the quality in offset printing machines", Offsetpraxis, dated Mar. 1976, pp. 34–42.

*Primary Examiner*—Eugene Eickholt
*Attorney, Agent, or Firm*—Herbert L. Lerner; Laurence A. Greenberg

[57] ABSTRACT

A method for controlling the formation of an image on a printing form carrier for a printing machine, wherein image signals serving to generate a printing form are taken from a storage memory of a computer and fed to an imaging device, includes storing, in one region of the storage memory, image data for reproducing a subject to be evaluated after printing; storing, in another region, image data for reproducing a multiplicity of digital print control elements for use in printing machines in a printing plant; assigning a job for a selected printing machine and making a selection of image data for digital print control elements with which the job is optimally monitorable on the machine for performing the assigned job; and combining the image data for the selected print control elements with the image data for reproducing the subject in a further region in the storage memory, with the aid of the computer, to produce an image data set for forming an image on the printing form carrier.

1 Claim, 3 Drawing Sheets

METHOD FOR CONTROLLING IMAGE FORMATION ON A PRINTING FORM CARRIER FOR A PRINTING PRESS

BACKGROUND OF THE INVENTION

Field of the Invention

The invention relates to a method for controlling image formation on a printing form carrier for a printing press, wherein image signals for producing a printing form are taken from a storage register or memory of a computer and fed to an imaging or image-forming device.

It is state of the art to combine images, text and graphics, in the form of digital data, into a full-page layout by means of a computer and a program. The full page layout is accordingly present in the form of a so-called PostScript data file in a storage register or memory of the computer. Print control elements, such as print control strips or bars with zonally arranged control fields, register marks and register crosses, can also be included in the PostScript data file. The print control elements are standardized and can be used only in printing presses wherein the print control elements are usable. By means of a raster image processor, the data of the PostScript file are converted into so-called bit map data. The bit map data are fed to an imaging device for forming an image of a printing form, a respective printing form being produced for each one of the process colors which are used.

It has been found to be disadvantageous that once a PostScript data file has been prepared, the type of printing presses which can be used is fixed because of the print control elements which are provided. Yet, precisely in printing plants, which employ printing presses, for example, from various manufacturers which operate with print control elements of different standards, it would be desirable to perform any arbitrary job on any arbitrary printing press, subject to the condition, of course, that the printing press be suitable with respect to quality for the job.

To overcome this disadvantage, it would have to be possible to integrate all the print control elements which might be suitable for a printing plant in every layout to be printed. In such a case, the unneeded print control elements would unnecessarily take up space on the printed product, this space being then no longer available for the otherwise further usable subject.

SUMMARY OF THE INVENTION

It is accordingly an object of the invention to provide a method for controlling image-formation on a printing form carrier which permits a flexible production of a printed product and improves the availability of industrial printing machines and presses used in a printing plant.

With the foregoing and other objects in view, there is provided, in accordance with the invention, a method for controlling the formation of an image on a printing form carrier for a printing machine, wherein image signals serving to generate a printing form are taken from a storage memory of a computer and fed to an imaging device, which comprises storing, in one region of the storage memory, image data for reproducing a subject to be evaluated after printing; storing, in another region, image data for reproducing a multiplicity of digital print control elements for use in printing machines in a printing plant; assigning a job for a selected printing machine and making a selection of image data for digital print control elements with which the job is optimally monitorable on the machine for performing the assigned job; and combining the image data for the selected print control elements with the image data for reproducing the subject in a further region in the storage memory, with the aid of the computer, to produce an image data set for forming an image on the printing form carrier.

Because the assembly or combination of the image data for the selected print control elements with the image data for the subject is not performed until after the print job has been assigned, it is possible to make the decision as to which of the printing machines the job will be run on relatively late in the process.

The aforementioned assembling or combining of data can be performed in the so-called PostScript file format or in the bit map data format, to which end the storage memory for the print control elements which are selected contains data in PostScript or bit map format. Combining the data can be effected with the computer and the program with which the PostScript data file is prepared, or with a raster-image processor, or with the computer which controls the imaging device.

The storage memory for the data of the print control elements which are to be selected can be accommodated in the region of the preprinting stage, or directly in the pressroom. For assembling or combining the data, the data for the print control elements to be selected can be transmitted via a local area network, to which all of the technical data processing devices or accessories and printing machines can be connected.

Other features which are considered as characteristic for the invention are set forth in the appended claims.

Although the invention is illustrated and described herein as a method of image-formation on a printing form carrier of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENT

Figure 1:
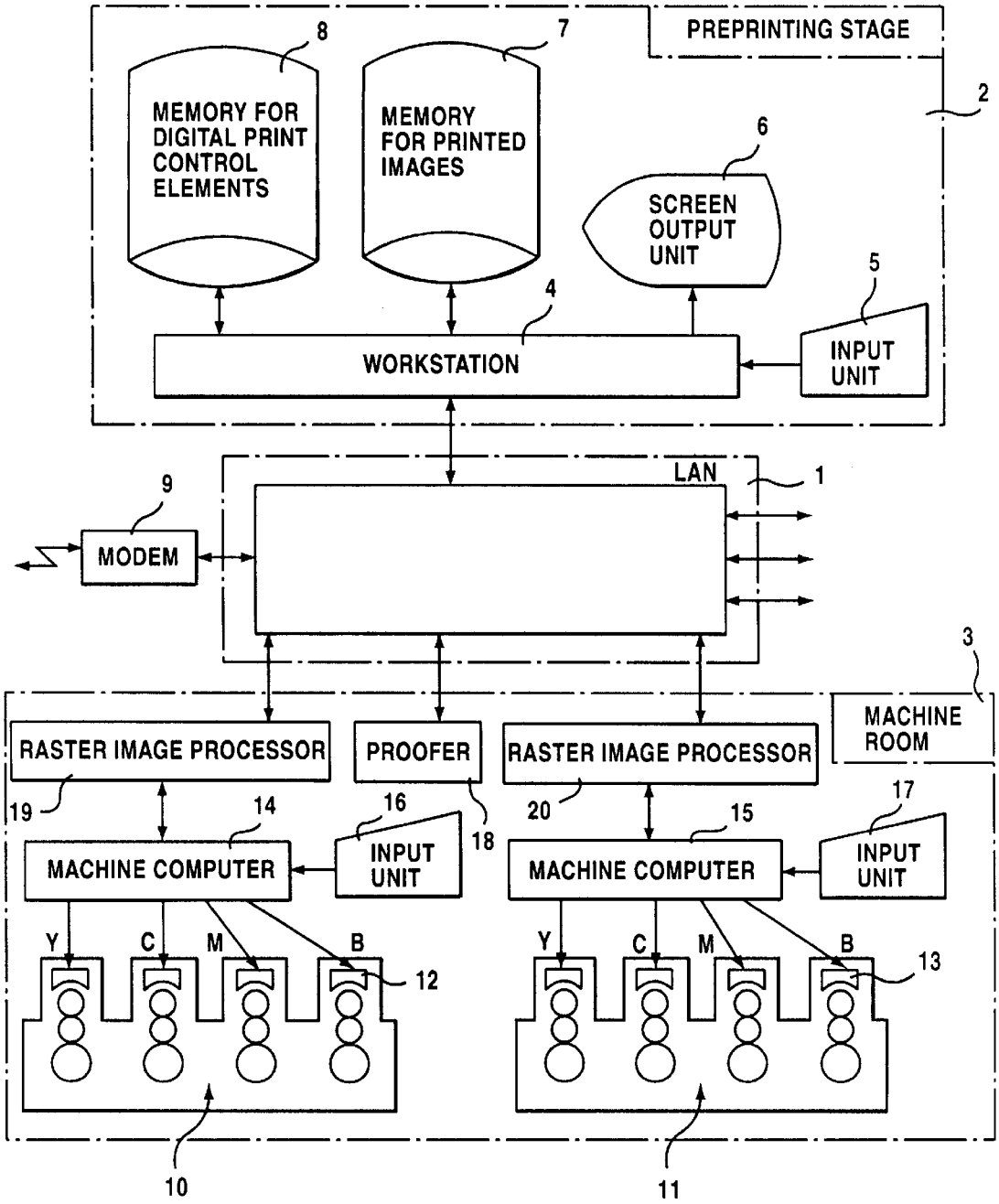
FIG. 1 is a diagrammatic and schematic view of a printing plant containing the devices necessary for performing the method of image-formation on a printing form carrier of a printing press in accordance with the invention.

Referring now to the drawings, and particularly to FIG. 1 thereof, there are shown therein, devices from a preprinting region or stage 2 of a printing plant which are connected to devices in a pressroom 3 via a local area network 1. A computer 4 located in the preprinting region 2 is provided with an input device 5 such as a keyboard or mouse, for example, a screen or monitor 6, a non-volatile storage 7 for data of printed images, and a non-volatile storage 8 for data of print control elements. The image data sets for the print control elements and for the printed images have no fixed association with one another, in the initial state. However, the image data sets have the same data format, such as the so-called PostScript format, for example, so that they can be processed together. The particular location at which the image data sets are stored is, in principle, unimportant. For example, the non-volatile storage may also be located outside the printing plant and may be transmitted from a distance via a modem 9 and the local area network 1.

Devices applicable to printing technology, namely printers and peripherals and the like, are located in the printing plant, as well as print control elements constructed in accordance with varying standards, which are used to control operating procedures. In an exemplary embodiment, two printing presses 10 and 11, respectively, are provided with four printing units Y, C, M and B having a mode of operation requiring that different print control strips and register marks be available in the printed image. In the printing presses 10 and 11, imaging units 12 and 13, by which images can be applied to or formed on printing form carriers, are provided in each of the printing units Y, C, M and B. The printed image contains the actual subject and the print control elements. Besides the print control elements, which are necessary for the modes of operation of the printing presses 10 and 11, print control elements required for the mode of operation of peripherals or devices employed in printing technology which are disposed downstream of the printing presses can also be provided. For example, the printed products can be supplied to folding and cutting devices which utilize special folding and cutting marks to control the folding or cutting register. For printers made by different manufacturers, entirely different configurations of marks may be necessary. The printing presses 10 and 11 are connected to machine computers 14 and 15, which furnish not only the control data for the printing presses 10 and 11, but also the bit map data for controlling the imaging units 12 and 13. A user has the capability of sending control commands via input units 16 and 17 to the printing presses 10 and 11, respectively. Also located in the pressroom is a proofer 18, with which hard copies of the printed image can be made before the imaging units 12 and 13 are set into operation.

Raster image processors 19 and 20 serve to generate data in bit map format from image data in PostScript format, the imaging units 12 and 13 being triggerable directly by the thus generated data.

After a determination has been made as to which printing press 10 or 11 and on which of the downstream devices a job will be performed, the image data which reproduce the subject and the image data which reproduce print control elements are assembled or combined. A method such as is described in the published German Patent Document DE 39 14 238 A1 may be employed for assigning jobs to the printers or printing presses 10 and 11. The decision as to which of the presses or printers 10 or 11 should perform the job can be made relatively late in the process. Depending upon the particular printers or presses 10 and 11, respectively, which may be assigned, the requisite print control elements are selected with the aid of the input unit 5 and the screen or monitor 6. This can be performed manually or automatically, if the program provided in the computer 4 accesses a list which shows an association of the requisite print control element with an assigned printer or press 10, 11.

The image data of the subject which is to be printed and the image data of the selected print control elements are assembled or combined with the aid of the computer 4 to form a unitary image data set for the printed image. The location of the print control elements in the printed image is fixed From the information about the respectively assigned printers 10 and 11, and must correspond with the scanning locations of photoelectric sensors which, by means of the print control elements, furnish actual value signals for controlling or regulating operating procedures of the applicable printer 10 or 11. The aforementioned program processes data for the print control elements from the non-volatile memory storage 8 and data for the subject from the storage 7. The assembled or combined data can be stored in the storage 7 as a PostScript file.

After all of the preparations for the re-application or re-forming of images of the printing forms have been made in the printing units Y, C, M and B, the PostScript file of the printed image is transmitted over the local area network 1 to the raster image processor 19. The conversion of the data of the printed image from the PostScript format to the bit map format is performed in the raster image processor 19. From then on, the image data can be supplied, with the aid of the press computer 14, to the imaging units 12 of the printing units Y, C, M and B.

As an aid in the process, a sample print of the entire printed image can be produced with the proofer 18 before the images are applied to or formed on the printing form. The assembled or combined data can be supplied to the proofer 18 in bit map format, for example.

The same procedure can be followed for the printing press 11 and all further peripherals and equipment involved in the printing arts and technology. In each printing press, the print control elements, which are useful or required for controlling or regulating or, in general, for accordingly operating the respective printing presses 10 and 11, are produced by the imaging units 12 and 13. All of the print control elements required to run respective folders, cutting and other folding equipment, which have been previously disposed downstream from the respective printing presses 10 and 11, are provided on the printed products leaving the respective printing press 10 and 11.

Figure 2:
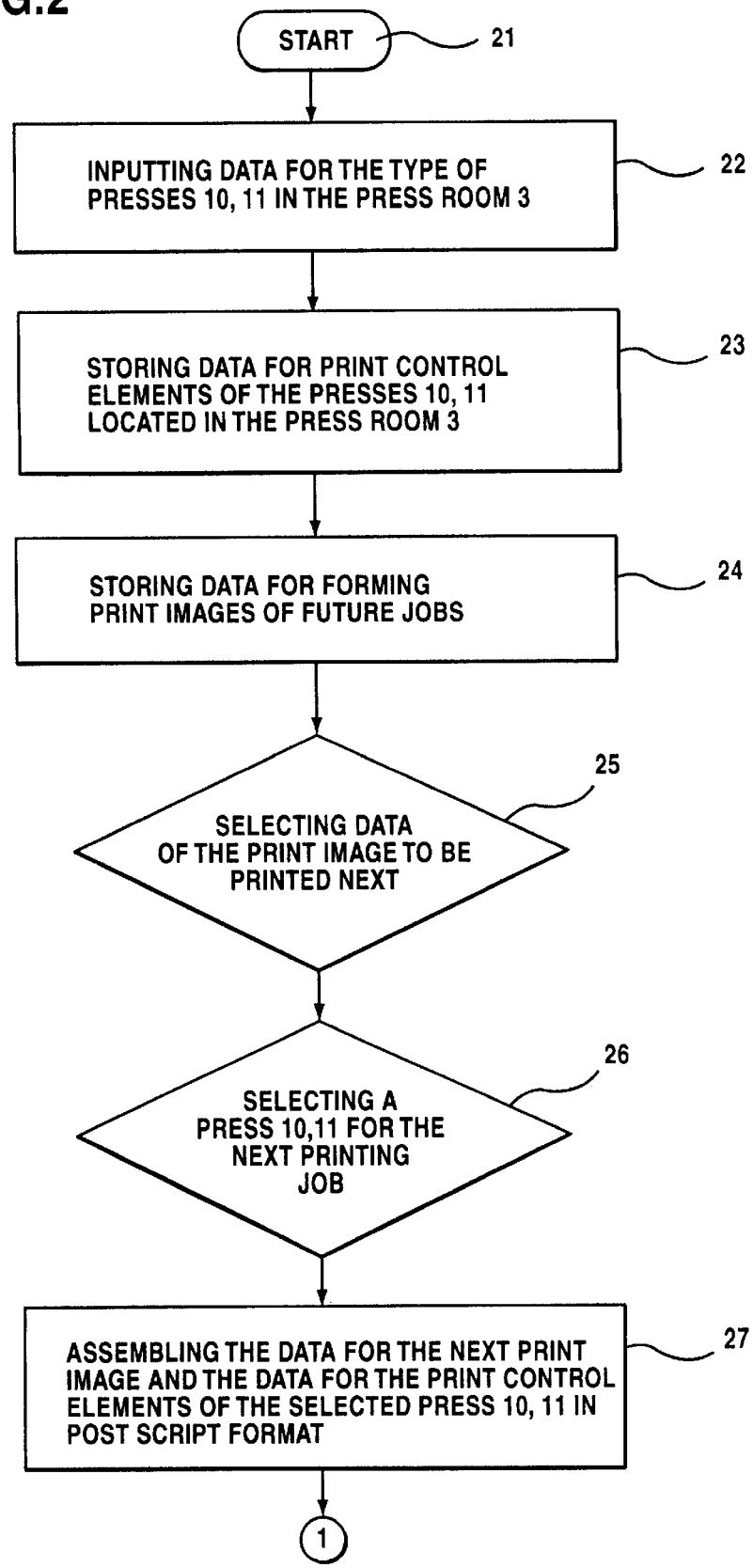
FIGS. 2 and 3 are a flow diagram outlining the steps of the method according to the invention which are performed by the devices of FIG. 1.
Figure 3:
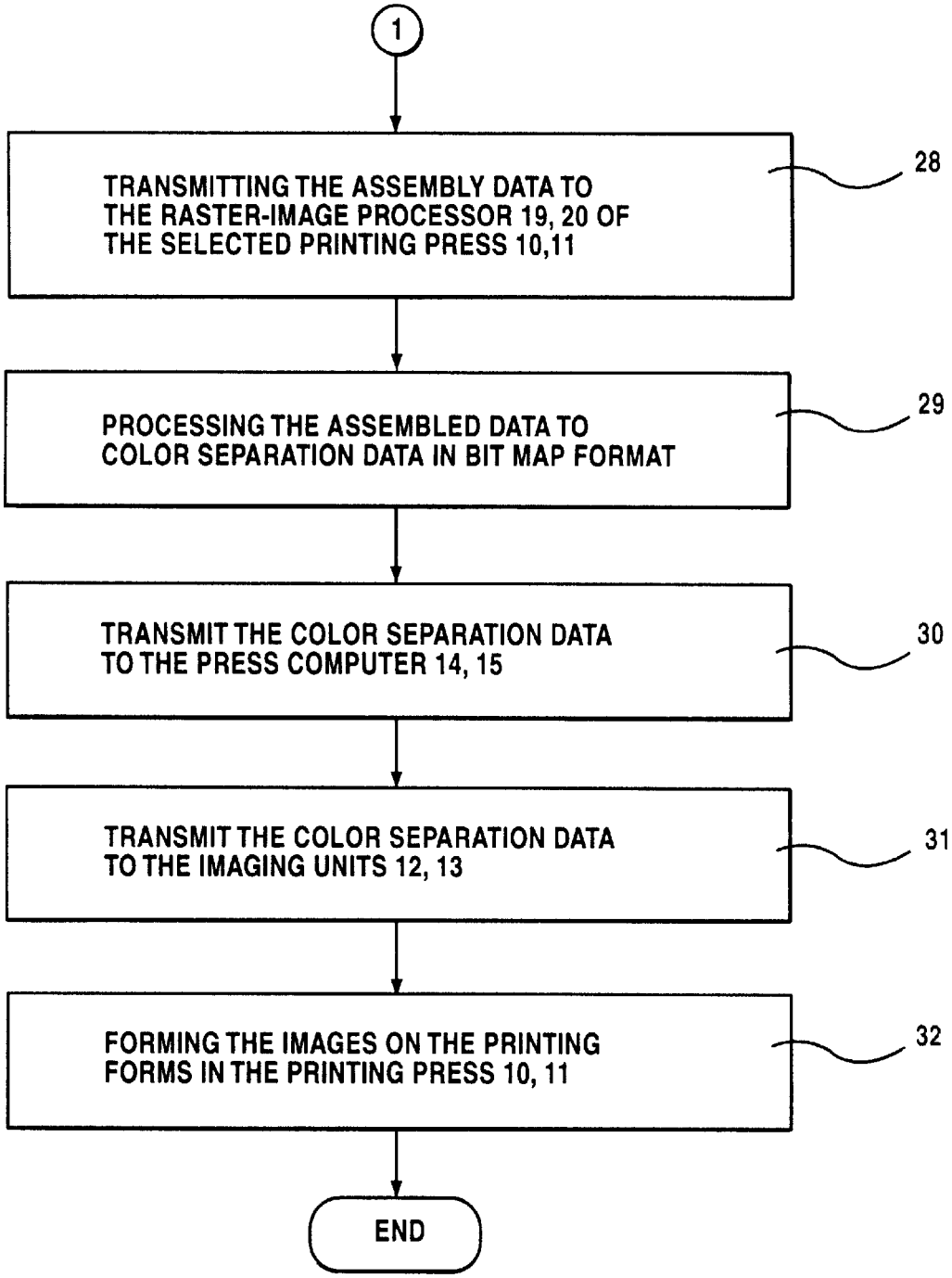

As reproduced in the program flow chart of FIGS. 2 and 3, after the start of the program at 21, the various steps of the program call for inputting data for the types of printing machines or presses 10 and 11 in the pressroom 3 at 22, storing data at 23 for print control elements of the printing machines 10 and 11, respectively, located in the pressroom 3, and storing data at 24 for forming print images of future jobs. There then follows a selection at 25 of data for the print image which is to be printed next, and a selection at 26 of the particular printing machine 10, 11 to be used for the next printing job. The next step of the program calls for assembling or combining at 27 the data for the next print image and the data for the print control elements of the previously selected printing machine 10 or 11 in PostScript format, followed by transmitting at 28 the thus assembled data to the raster-image processor 19, 20 of the selected printing machine 10 or 11. The assembled data are then processed at 29 to color separation data in bit map format, and the color separation data are transmitted at 30 to the printing-machine computer 14, 15. Thereafter, the color separation data are transmitted at 31 from the respective printing-machine computers 14 and 15 to the respective imaging units 12 and 13, and corresponding images are then formed at 32 on the printing forms in the respective printing machine 10, 11 to end the program.

We claim:

1. A method for controlling the formation of an image on a printing form carrier for a printing machine, which comprises:

storing, in one region of a storage memory, image data for reproducing a subject to be evaluated after printing;

storing, in another region, image data for reproducing a multiplicity of digital print control elements for use in various types of printing machines in a printing plant;

assigning a job for a selected printing machine and making a selection of image data for reproducing the digital print control elements from the image data for reproducing the digital print control elements stored in the storage memory with which the job is monitored on the machine for performing the assigned job;

combining the image data for the selected print control elements with the image data for reproducing the subject in a further region in the storage memory, with the aid of a computer, to produce an image data set for forming an image of the data set on the printing form carrier; and producing the printing form carrier in the printing machine.

* * * * *